US011828123B2

(12) United States Patent
Cox

(10) Patent No.: US 11,828,123 B2
(45) Date of Patent: Nov. 28, 2023

(54) SYSTEM, APPARATUS, AND METHOD FOR MAINTAINING A POLISHING ROD

(71) Applicant: Lance Cox, Roosevelt, UT (US)

(72) Inventor: Lance Cox, Roosevelt, UT (US)

( * ) Notice: Subject to any disclaimer, the term of this patent is extended or adjusted under 35 U.S.C. 154(b) by 0 days.

(21) Appl. No.: 17/387,834

(22) Filed: Jul. 28, 2021

(65) Prior Publication Data

US 2023/0035424 A1 Feb. 2, 2023

(51) Int. Cl.
*E21B 33/03* (2006.01)
*E21B 43/12* (2006.01)

(52) U.S. Cl.
CPC ..... *E21B 33/03* (2013.01); *E21B 43/127* (2013.01)

(58) Field of Classification Search
CPC ..... E21B 33/03; E21B 43/127
USPC ..... 166/84.1
See application file for complete search history.

(56) References Cited

U.S. PATENT DOCUMENTS 2,137,832 A * 11/1938 Cordes ..... E21B 33/08 166/81.1
2,290,507 A 7/1942 Thompson
3,774,354 A 11/1973 Taylor
5,150,751 A * 9/1992 Burton ..... E21B 33/08 166/93.1
5,526,877 A 6/1996 Winz
6,152,220 A 11/2000 Carmichael et al.
7,870,897 B2 1/2011 Telfer
8,162,723 B2 4/2012 Spiro et al.
8,783,360 B2 7/2014 Zediker et al.
9,228,410 B2 * 1/2016 Brewer ..... E21B 43/127
9,458,699 B2 10/2016 Monjure et al.
9,784,055 B1 * 10/2017 Bair ..... E21B 33/08
2010/0181064 A1 7/2010 Knobloch et al.
2013/0269927 A1 * 10/2013 Woods ..... E21B 33/08 166/84.1
2015/0007978 A1 * 1/2015 Brewer ..... E21B 43/0122 166/81.1

* cited by examiner

*Primary Examiner* — Matthew R Buck
*Assistant Examiner* — Patrick F Lambe
(74) *Attorney, Agent, or Firm* — Kunzler Bean & Adamson

(57) ABSTRACT

An anchor preserves the seal on an oscillating polishing rod in a pumpjack. The anchor has first and second sidewalls. The sidewalls are joined and oriented in opposite directions to create a cylindrical sidewall for the anchor. The cylindrical sidewall extends about a longitudinal axis and is coupled to a radial hinge that is substantially parallel to the longitudinal axis. The radial hinge couples the first sidewall relative to the second sidewall and facilitates the opening and closing of the cylindrical sidewall to create a clamping area in the locked position. A transverse hinge extends in an orthogonal direction relative to the radial hinge. The transverse hinge supports a rotating shaft on the exterior surface of the sidewall. A clasp on the opposite end of the shaft selectively and optionally locks the first sidewall relative to the second sidewall to create the clamping area of the anchor.

20 Claims, 8 Drawing Sheets

SYSTEM, APPARATUS, AND METHOD FOR MAINTAINING A POLISHING ROD

FIELD

This invention relates to petroleum well mechanical lifts and more particularly relates to maintaining the polishing rod of the mechanical lift during repetitive oscillations through the wellhead.

BACKGROUND

Wells are often used to bring a natural resource, such as petroleum, from an underground reservoir to the surface. The reservoir pressure varies over the operational lifetime of the well. The formation fluids entering the base of the well may need mechanical pressure, head, and/or lift to force the liquid resource out of the well. In general, a well that has seen limited service may have a reservoir pressure that forces the entrapped resource in the reservoir through the well. However, the extraction of the natural resource decreases the pressure in the reservoir. With time, the reservoir pressure may decrease to a point where there is insufficient pressure to force the fluid in the reservoir through the well and out to the surface. When the reservoir is pressurized, the well is passive and utilizes the underground pressure to extract the petroleum from the reservoir.

When the reservoir pressure drops, a mechanical lift may extract the natural resource from the reservoir. Over time, as the reservoir depletes, the natural resource and the reservoir pressure decreases. The well may become unproductive. Without some active force or pressure, the underground resource remains in the reservoir. Due to the cost of drilling the well, abandoning the underground resource in the reservoir may result in an operational loss for the operator. Thus, an active means of extracting petroleum from the reservoir increases the value of the well and may cause the extraction from reservoirs that would otherwise be economically impractical.

One method of extracted petroleum from a low-pressure reservoir, e.g., a reservoir where active pressure is needed to extract the petroleum, is a mechanical lift. Mechanical lifts are commonly called pumpjacks and are used to lift the petroleum from the reservoir to the wellhead at the surface. A lever commonly referred to as a walking beam oscillates a cable coupled to a polished rod. The polished rod is coupled to the pump barrel at the well bottom (e.g., in the reservoir) through a series of sucker rods. The polished rod oscillates and lifts a pump barrel in the formation fluids at the bottom of the well to lift/pump the fluid out of the well.

The oscillation of the pumpjack operation causes the polishing rod to enter and exit the wellhead. The polishing rod is exposed to the fluids within the well and the oxidizing agents outside the well. Thus, the area of the polishing rod that oscillates through the wellhead may corrode, rust, and/or warp. These abnormalities may also increase the energy to operate the mechanical lift and may reduce the output of the well. A system is described that preserves the smooth exterior and utilizes the oscillations of the polishing rod to maintain the mechanical lift.

SUMMARY

An apparatus for polishing an oscillating rod on a petroleum oil lift is disclosed. A system and method are also disclosed to perform the functions of the apparatus.

In one example, the apparatus to preserve a seal on an oscillating rod includes an anchor. The oscillating rod defines a longitudinal axis relative to the anchor in an installed position. The anchor has first and second sidewalls that extend around the longitudinal axis and are opposite one another. The anchor has a radial hinge that extends parallel to the longitudinal axis and couples the first sidewall to the second sidewall. The radial hinge is outside of the first and second sidewalls. The radial hinge is located on an external surface of the first sidewall and/or the second sidewall. A second or transverse hinge extends from the external surface about a transverse axis orthogonal to the longitudinal axis. The transverse hinge couples a clasp on a shaft to one of the first and second sidewalls to secure the anchor about the oscillating rod. The shaft is located on the exterior surface of either the first or second sidewalls, and the clasp is located opposite the transverse hinge. The clasp selectively couples the shaft to the first or second sidewall. The preceding subject matter of this paragraph characterizes example 1 of the present disclosure.

The first sidewall is a semicircle and the second sidewall is a semicircle. The second sidewall is opposite the first sidewall to create a cylindrical sidewall. The preceding subject matter of this paragraph characterizes example 2 of the present disclosure, wherein example 2 also includes the subject matter according to example 1 above.

A magnet is located on one of the first sidewall and the second sidewall that couples the anchor to a wellhead. The preceding subject matter of this paragraph characterizes example 3 of the present disclosure, wherein example 3 also includes the subject matter according to any of examples 1-2 above.

The anchor is made from a thermoset or thermoplastic. The anchor comprises one or more of polycarbonate, polyvinyl chloride, or Acrylonitrile Butadiene Styrene. The preceding subject matter of this paragraph characterizes example 4 of the present disclosure, wherein example 4 also includes the subject matter according to any of examples 1-3 above.

The anchor is made from a metallic material. The preceding subject matter of this paragraph characterizes example 5 of the present disclosure, wherein example 5 also includes the subject matter according to any of examples 1-4 above.

A mooring hitch extends from the first sidewall and the second sidewall that secures the anchor on a wellhead. The preceding subject matter of this paragraph characterizes example 6 of the present disclosure, wherein example 6 also includes the subject matter according to any of examples 1-5 above.

A support bracket is opposite the mooring hitch and extends from the first sidewall and the second sidewall. The support bracket secures the anchor on an O-ring of the oscillating rod. The preceding subject matter of this paragraph characterizes example 7 of the present disclosure, wherein example 7 also includes the subject matter according to example 6 above.

The mooring hitch has a protrusion with a first portion that extends in a transverse direction from the first sidewall or the second sidewall. The protrusion has a bend such that a second portion of the protrusion extends parallel to the longitudinal axis. The preceding subject matter of this paragraph characterizes example 8 of the present disclosure, wherein example 8 also includes the subject matter according to example 7 above.

The support bracket has a projection that has a first portion that extends at an angle from the first sidewall and the second sidewall and a second portion that forms an obtuse angle with the first portion of the projection. The preceding subject matter of this paragraph characterizes example 9 of the present disclosure, wherein example 9 also includes the subject matter according to example 8 above.

An inner surface opposite the external surface of the first sidewall and the second sidewall. The inner surface forms a gap around the oscillating rod. The preceding subject matter of this paragraph characterizes example 10 of the present disclosure, wherein example 10 also includes the subject matter according to any of examples 1-9 above.

The gap has packed sand that abrades the oscillating rod along the longitudinal axis. The preceding subject matter of this paragraph characterizes example 11 of the present disclosure, wherein example 11 also includes the subject matter according to example 10 above.

The oscillating rod has a concave square cross-sectional shape. The preceding subject matter of this paragraph characterizes example 12 of the present disclosure, wherein example 12 also includes the subject matter according to example 11 above.

The oscillating rod has a circular cross-sectional shape with a first radius, and the anchor has a cylindrical sidewall with a second radius. The second radius is more than one-half inch greater than the first radius. The preceding subject matter of this paragraph characterizes example 13 of the present disclosure, wherein example 13 also includes the subject matter according to example 12 above.

In another example, an anchor is described that includes a cylindrical sidewall. The cylindrical sidewall has a first jaw and a second jaw opposite the first jaw. In a closed position, the first jaw and the second jaw define a clamping area. A radial hinge is externally located on the first jaw and/or the second jaw so that the radial hinge is external from the clamping area in the closed position. The radial hinge rotates the first jaw and the second jaw between an open position and a closed position. An abradant may be captured in the clamping area between the first jaw and the second jaw. A clasp is located opposite the radial hinge and locks the first jaw relative to the second jaw. The clasp and jaws provide a compressive force and retain the abradant in the clamping area. The preceding subject matter of this paragraph characterizes example 14 of the present disclosure.

The abradant is made from a carbide steel material. The preceding subject matter of this paragraph characterizes example 15 of the present disclosure, wherein example 15 also includes the subject matter according to example 14 above.

An opening between the first jaw and the second jaw in the open position is greater than the outer diameter of an oscillating rod. The clamping area has an internal diameter that is less than the diameter of the oscillating rod. The preceding subject matter of this paragraph characterizes example 16 of the present disclosure, wherein example 16 also includes the subject matter according to any of examples 14-15 above.

A pad interposed between the cylindrical sidewall and the abradant. The preceding subject matter of this paragraph characterizes example 17 of the present disclosure, wherein example 17 also includes the subject matter according to any of examples 14-16 above.

The pad creates a normal spring force on a corrosion layer of an oscillating rod. The preceding subject matter of this paragraph characterizes example 18 of the present disclosure, wherein example 18 also includes the subject matter according to any of examples 14-17 above.

In another embodiment, an apparatus is described to preserve a seal on an oscillating rod. The apparatus has an anchor extending along a longitudinal axis defined along the axis of the oscillating rod. The first and second sidewalls of the anchor extend about the longitudinal axis opposite each other. A radial hinge extends parallel to the longitudinal axis and couples the first sidewall to the second sidewall on an external surface of the first sidewall and the second sidewall. A transverse hinge extends from the external surface and along a transverse axis orthogonal to the longitudinal axis. The transverse hinge couples a shaft on the exterior surface of either the first or second sidewalls and a clasp on the shaft. The transverse hinge selectively couples the shaft to the other sidewall. The preceding subject matter of this paragraph characterizes example 19 of the present disclosure.

A mooring hitch has a protrusion extending from the cylindrical sidewall that secures the anchor on a wellhead and a support bracket having a projection opposite the mooring hitch extending from the cylindrical sidewall that secures the anchor on an O-ring that seals the oscillating rod. An angle of a bend in the protrusion is less than an angle of a bend in the projection. The preceding subject matter of this paragraph characterizes example 20 of the present disclosure, wherein example 20 also includes the subject matter according to example 19 above.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not, therefore, to be considered to be limiting of its scope, the invention will be described and explained with additional specificity and detail through the use of the accompanying drawings, in which.

DETAILED DESCRIPTION

Figure 1:
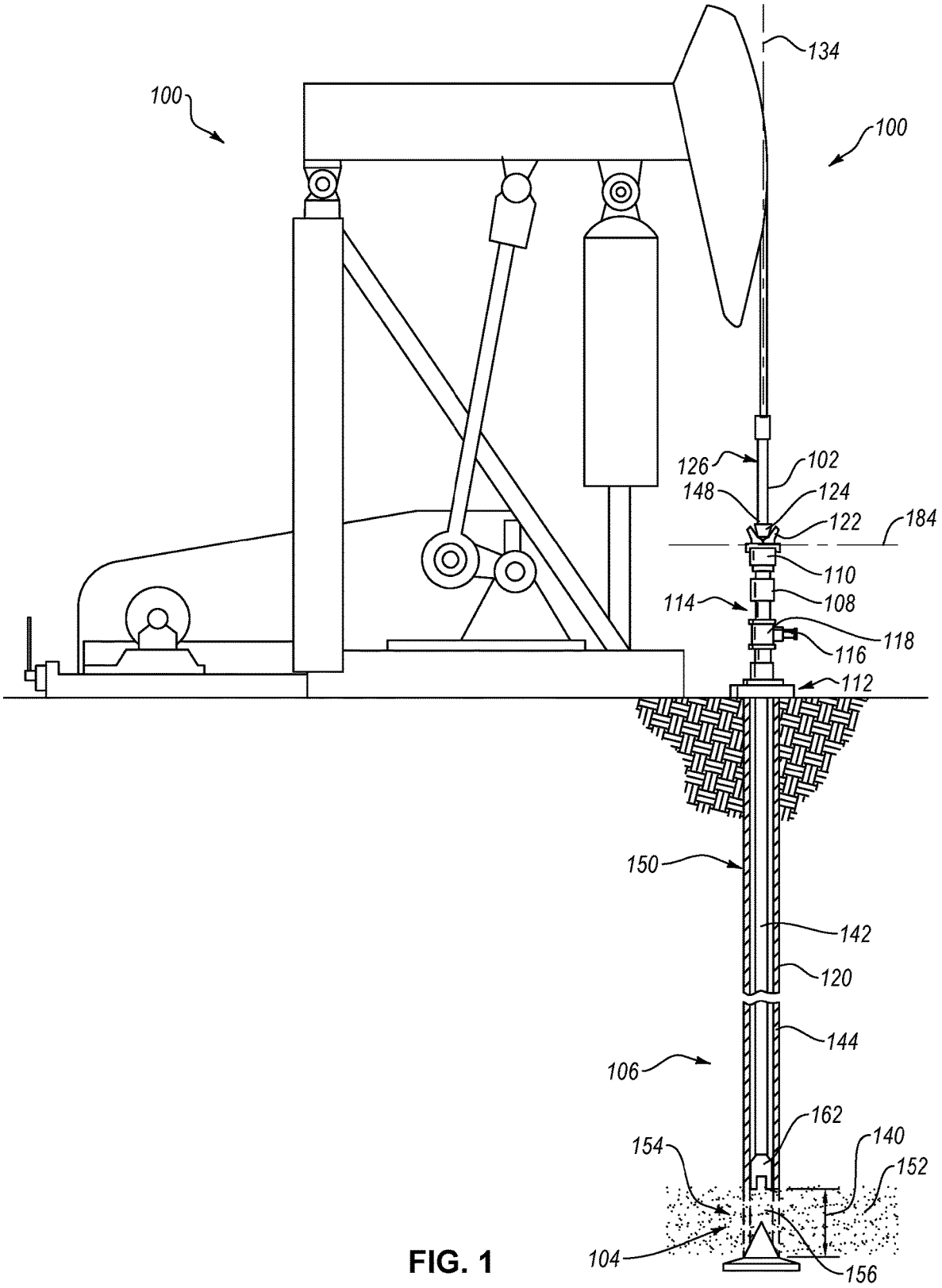
FIG. 1 is a side view illustrating one embodiment of a pumpjack, according to an exemplary embodiment.

A well may obtain access to an underground reservoir and extract natural resources from the underground reservoir. A well is a bored, drilled, or driven shaft with a depth that exceeds the most significant surface dimension and enables the operator to extract the natural resource from an underground reservoir. A passive well occurs where the reservoir pressure is sufficient to force the resource in the reservoir to the surface of the well. In contrast, active wells utilize an external source of force and/or pressure to extract the resource. For example, an injection well injects a fluid into the well to increase the pressure in the reservoir and extract the natural resource. Similarly, lifts and mechanical pumps mechanically lift the natural resource, e.g., out of the wellhead.

A person having ordinary skill in the art would recognize that a well can be adapted to extract a wide variety of natural resources including, water, gas, oil, petroleum, solid minerals, and the like. For simplicity only, the present discussion is focused on petroleum extraction; however, it is understood that the same or similar principles apply for the extraction of other liquid natural resources.

Mechanical lifts are often employed to extract petroleum, for example, by using valves to lift the formation fluids that collect at the bottom of the well. Formation fluids collect (e.g., passively or through an actively supplied pressure) in the bottom of the well and are extracted with a mechanical lift. A similar mechanical pumping device is adapted for gas and/or solid natural resource extraction. The mechanical lift oscillates a working head or pump barrel at the bottom of the well that actively lifts the resource (e.g., oil) from the reservoir. Specifically, the pump barrel provides the energy to lift the formation fluids at the bottom of the well to the surface. The components that couple the energy at the wellhead to the pump barrel at the bottom include a polishing rod that oscillates through the wellhead and one or more entirely encapsulated sucker rods.

Maintenance of the polishing rod and/or sucker rods extend the lifetime of the mechanical lift assembly and enhances the operational lifecycle of the well. For example, maintenance of the polishing rod may reduce the load on the engine (commonly referred to as a primary mover) that oscillates the polishing rod. In other words, proper maintenance of the polishing rod increases the output by enhancing the power delivered to the downhole pump. Maintaining the polishing rod reduces operational time losses and/or other costly repairs to other components of the mechanical lifting system, such as the primary mover. The polishing rod oscillates from an exterior environment (outside the wellhead) and an internal environment (within the wellhead casing). These different environments oxidize, corrode, and/or deform the polishing rod. Discussed herein is a method of maintaining the polishing rod during the operation of the mechanical lift. The maintenance is performed without clutching or stopping the mechanical lift.

FIG. 1 is a side view illustrating one embodiment of a vertical mechanical lift, shown as a pumpjack 100. The pumpjack 100 has a polishing rod 102 that oscillates a downhole pump 104 at the bottom of a well 106. The pumpjack 100 powers the downhole pump 104 to lift the fluid out from the bottom of the well 106. The polishing rod 102 oscillates through a stuffing box 108 that terminates at a wellhead 110. The wellhead 110 and stuffing box 108 receive the polishing rod 102 as it oscillates through the various fittings and pressurizes the fluid in the well 106. The well exit 112 has a collection of fittings commonly referred to as a tree 114 that diverts the extracted natural resource. The tree 114 separates the oscillating motion of the polishing rod 102 from the extracted petroleum, which flows through the flow line 116. To separate the motion of the polishing rod from the flow of the extracted fluid, the tree 114 includes a t-fitting 118 that diverts the lifted petroleum through the flow line 116 from the oscillating movement of the polishing rod 102. The stuffing box 108 is interposed between the wellhead 110 at the top of the stuffing box 108 and the t-fitting 118. The stuffing box 108 orients the polishing rod 102 as it oscillates through the casing 120 in the well 106.

As described in greater detail below, a rod polisher apparatus, shown as anchor 122, is coupled to the wellhead 110. The anchor 122 polishes and maintains the polishing rod 102 as it oscillates through the wellhead 110. In various embodiments, the design of the anchor 122 is such that installation and/or removal of the anchor 122 can take place without having to clutch or stop the operation of the pumpjack 100. In other words, one feature of the anchor 122 is that it uses the oscillations of the polishing rod 102 to maintain the pumpjack 100 without pausing or halting the operation of the pumpjack 100. For example, the anchor 122 abrades the exterior of the pumpjack 100 to prevent the accumulation of corrosion, rust, or deformations on the polishing rod 102. In other words, the anchor 122 utilizes the oscillations of the polishing rod 102 to abrade and maintain a smooth, straight polishing rod 102.

The anchor 122 preserves a seal 124 on the wellhead 110 by reducing the deformations on an exterior surface 126 of the polishing rod 102. The anchor 122 is installed about the polishing rod 102 and clamps around the polishing rod 102 to provide an abrasive process that abrades the exterior surface 126 and maintains a smoothed/polished exterior surface 126 on the polishing rod 102. For example, in various embodiments, the anchor 122 abrades the polishing rod 102 to remove any corrosion, abnormalities, or other defects that develop during the operation of the pumpjack 100. The smooth exterior surface 126 created by the anchor 122 on the polishing rod 102 results in less friction at the wellhead 110 and/or maintains the seal 124 about the polishing rod 102.

Figure 7:
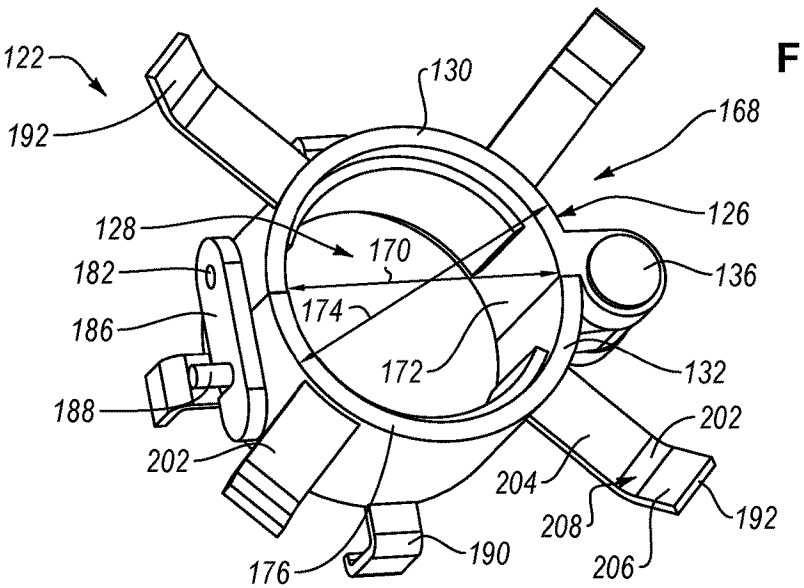
FIG. 7 is a top view of an anchor, according to an exemplary embodiment.
Figure 8:
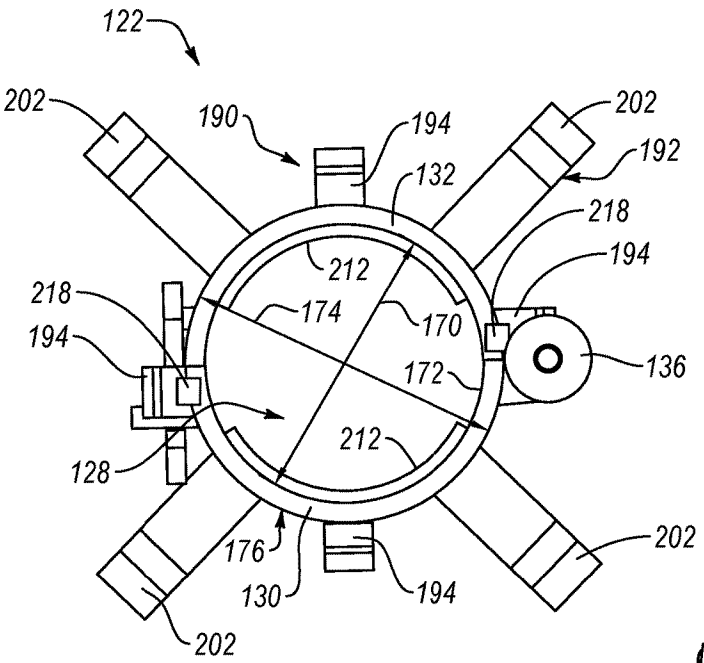
FIG. 8 is a bottom view of the anchor, according to an exemplary embodiment.
Figure 11:
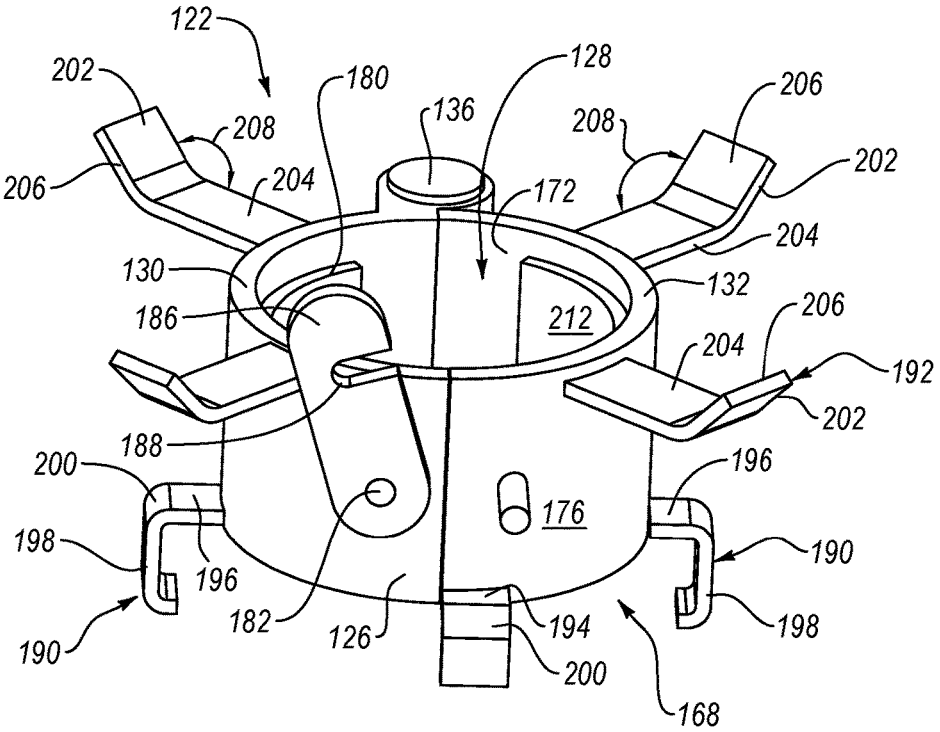
FIG. 11 is a side perspective view of the anchor where the transverse hinge is unlocked, and the anchor is in a closed position, according to an exemplary embodiment.
Figure 12:
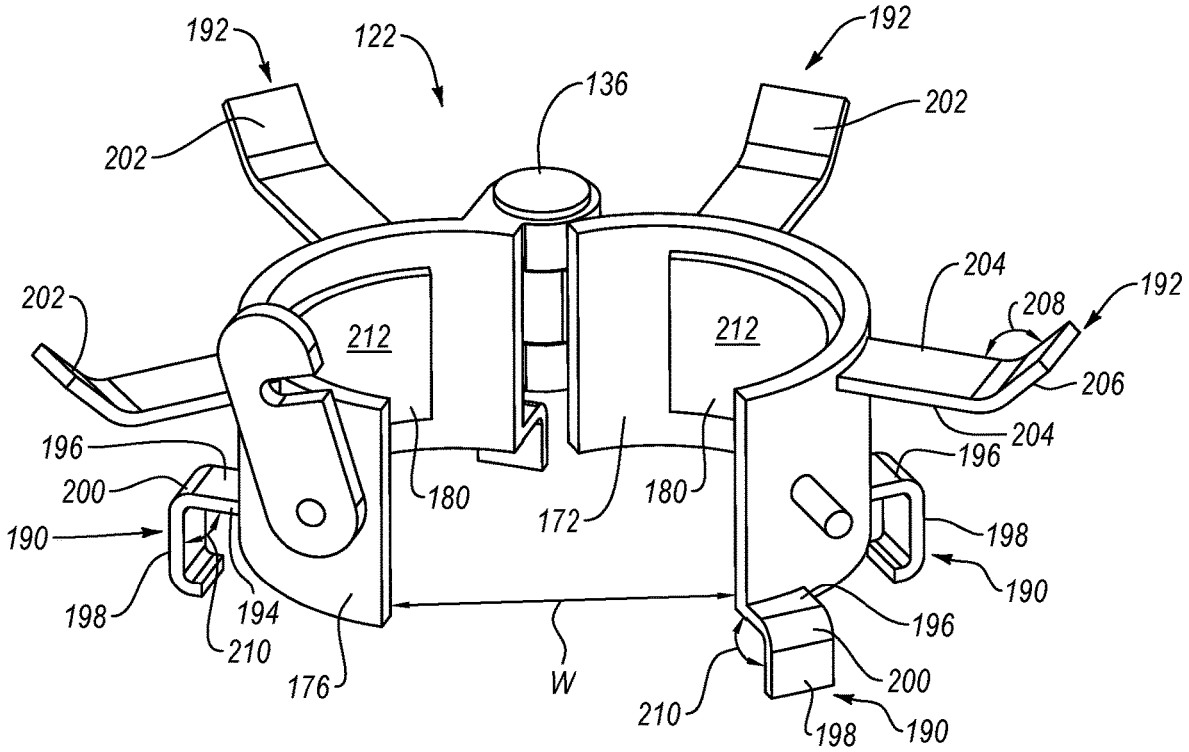
FIG. 12 is a side perspective view of the anchor where the transverse hinge is unlocked, and the anchor is in an open position, according to an exemplary embodiment.

The anchor 122 is installed about the polishing rod 102 and abuts the wellhead 110. The anchor 122 uses a clamp-like operation, having opposing jaws or sidewalls that create an enclosed or clamping area 128 when the anchor is locked in the closed position (FIGS. 7 and 8). For example, the anchor 122 has a first jaw or sidewall 130 and a second jaw or sidewall 132 captured about a longitudinal axis 134 of the polishing rod 102. The first sidewall 130 and the second sidewall 132 are oriented opposite one another and open a width W (FIG. 12) to surround the polishing rod 102. Stated differently, the first sidewall 130 and the second sidewall 132 cooperate to open a width W, as shown in FIG. 12, and close in a clamp-like configuration shown in FIG. 11, during operation of the polishing rod 102.

The radial hinge 136 opens and closes the first sidewall 130 and the second sidewall 132. The anchor 122 is shown in an open position in FIG. 12. FIG. 11 shows the radial hinge 136 closes to clamp down on the polishing rod 102 and abrade the exterior surface of the polishing rod during each oscillation. The radial hinge 136 also enables rotation of the first sidewall 130 relative to the second sidewall 132 to create a clamping area 128 in the closed position. In one example, the radial hinge 136 is located externally from the clamping area 128 and rotates semicircular sidewalls (e.g., first sidewall 130 and the second sidewall 132) between the open position illustrated in FIG. 12 and the closed position illustrated in FIG. 11.

FIG. 1 shows a stroke length 140 of the downhole pump 104, defined as the difference between the maximum and minimum elevations of the downhole pump 104. As the polishing rod 102 and sucker rods 142 oscillate the downhole pump 104 at the bottom of the well 106, the downhole pump 104 moves between the maximum and minimum elevations and mechanically lifts and extracts the natural resource from the reservoir. The well 106 has two concentric pipes that provide pressure differentials and facilitate the downhole pump 104. An external casing 120 surrounds an inner tubing 144 to create two volumes that can be pressurized and extract the natural resource. The downhole pump 104 lifts the fluid through the casing 120 and/or the tubing 144 from the bottom of the well 106 to a well exit 112 at the surface.

Figure 2:
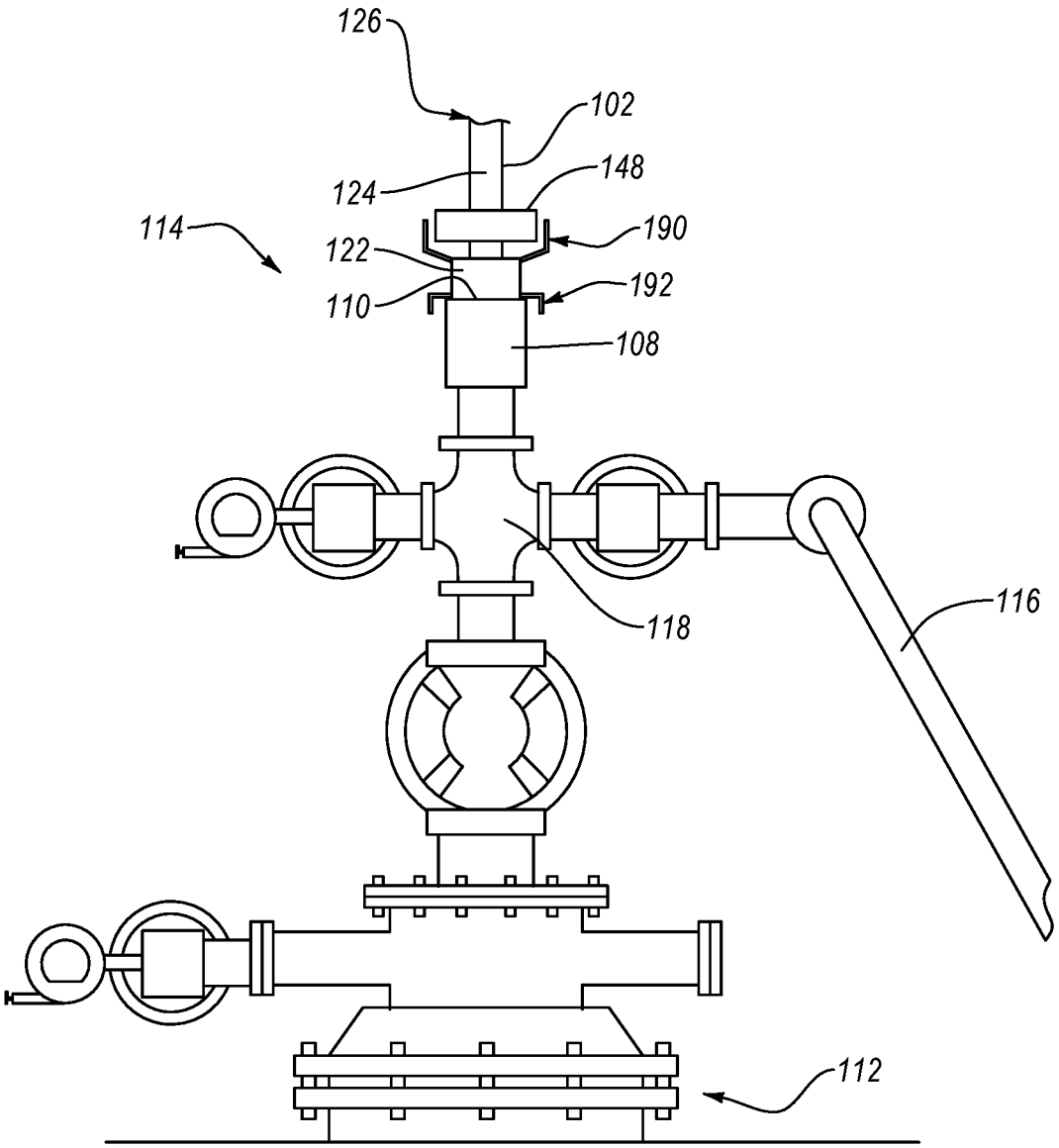
FIG. 2 is a side detail view illustrating the wellhead shown in FIG. 1, according to an exemplary embodiment.

FIG. 2 is a detailed view of the tree 114 and shows the t-fitting 118 that diverts the pumped petroleum through the flow line 116 while enabling the polishing rod 102 to oscillate through the stuffing box 108. The wellhead 110 is shown directly on top of the stuffing box 108. The entire structure of FIG. 2 is sometimes referred to as a wellhead. However, as used in this application, the tree 114 structure shown in FIG. 2 is distinguished from the fitting, called the wellhead 110, located on top of the stuffing box 108. The wellhead 110 refers to the fitting on the top of the stuffing box 108 that receives the anchor 122 and the polishing rod 102. The wellhead 110 maintains the seal 124 on the polishing rod 102 with an O-ring 148 surrounding the polishing rod 102 and interposed between the external environment and the drill hole 150 of the well 106. In other words, the O-ring 148 maintains the seal 126 as the polishing rod 102 oscillates through the wellhead 110 and mechanically lifts, or pumps, the petroleum from the bottom of the well 106 to the flow line 116.

Figure 3:
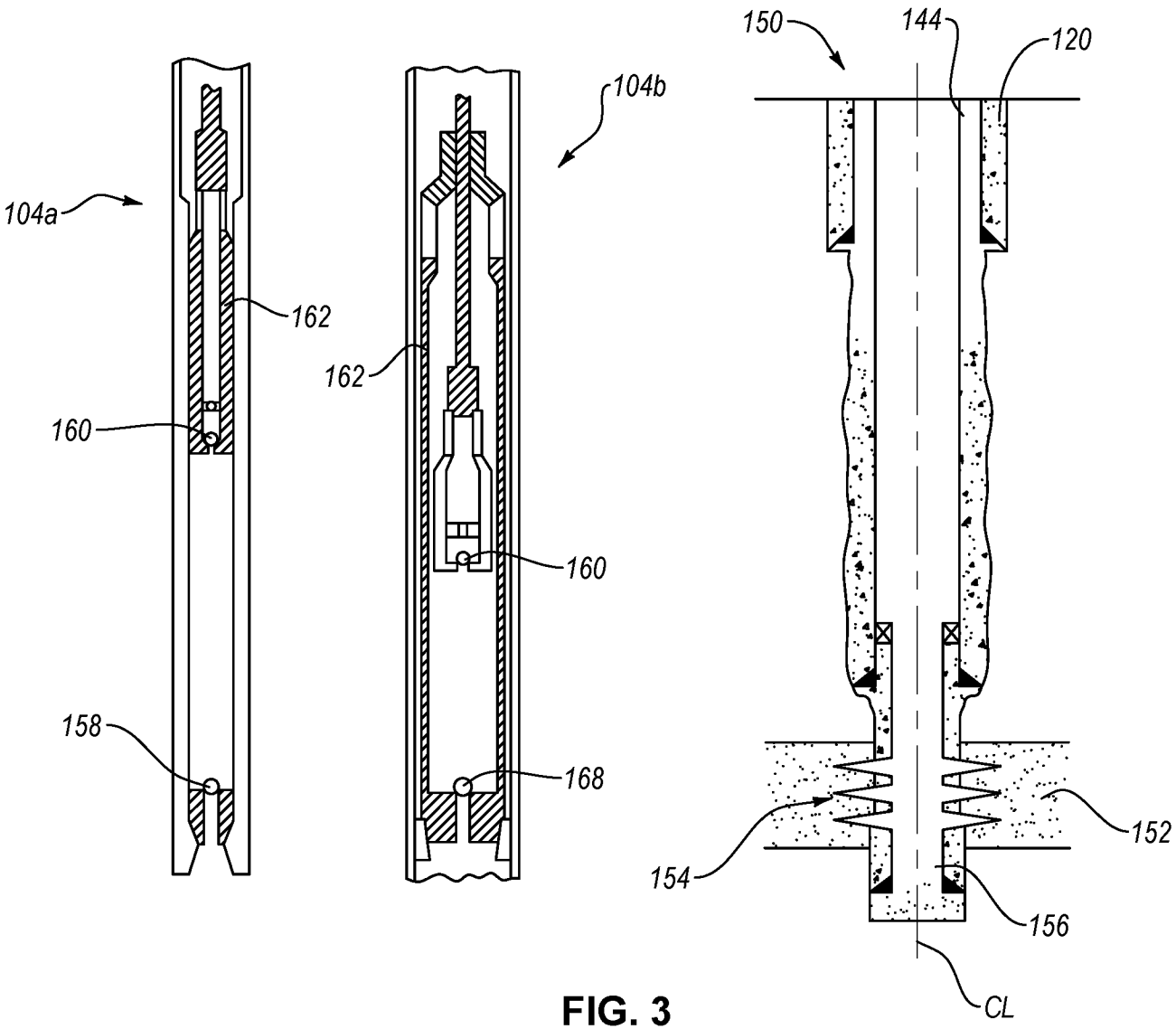
FIG. 3 is a cross-sectional side view illustrating the downhole pump of the well, according to an exemplary embodiment.

FIG. 3 shows a cross-section of the downhole pump 104 at the bottom of the well 106. The reservoir 152 surrounds perforations 154 in the casing 120 at the bottom of the well 106 that enables the natural resource, e.g., petroleum, to enter the well 106 and be extracted by the mechanical lift (e.g., pumpjack 100). The fluid that enters the well 106 is called formation fluid 156 and accumulates at the bottom of the well 106. The well receives and collects the accumulated formation fluids 156. The formation fluids 156 accumulate within the well 106 through the perforation 154 of the casing 120. The pumpjack 100 acts on the formation fluids 156 to extract them from the well 106. In other words, the pumpjack 100 lifts the formation fluids 156 as the polishing rod 102 oscillates the downhole pump 104. Each oscillation of the polishing rod 102 results in one stroke length 140 of the downhole pump 104 for each cycle. The downhole pump 104 lifts the formation fluid 156 from the bottom to the surface of the well 106.

FIGS. 3(A) and 3(B) show two different types of downhole pump 104. Specifically, FIG. 3(A) shows a tubing pump 104*a*, and FIG. 3(B) shows a rod pump 104*b*. The tubing pump 104*a* and the rod pump 104*b* create a head pressure to lift the formation fluid 156. The tubing pump 104*a* differs from the rod pump 104*b* based on the location the fluid exits the downhole pump 104. The tubing pump 104*a* pumps the fluid through the inner tubing 144 and the rod pump 104*b* exits the fluid into the casing 120. Both the tubing pump 104*a* and the rod pump 104*b* have a standing valve 158 and a traveling valve 160. The tubing pump 104*a* and the rod pump 104*b* pressurize the flow of the petroleum into the tubing 144 and/or casing 120 during each oscillation and create the mechanical lift to extract the petroleum.

When the anchor 122 oscillates downward, it forces the downhole pump 104 (e.g., either the tubing pump 104*a* and/or the rod pump 104*b*) into the formation fluid 156. The standing valve 158 and the traveling valve 160 are forced open, and the formation fluid 156 enters the cavity within the downhole pump 104. The open standing valve 158 captures the formation fluid 156 (e.g., petroleum or oil) into the well 106 and forces the formation fluid 156 upward, either through the tubing 144 or the casing 120 of the well 106. The polishing rod 102 couples to a series of sucker rods 142 that collectively pull the downhole pump 104 upward and pressurize the fluid in the well 106. In other words, any number of sucker rods 142 can be introduced to the system between the polishing rod 102 and the pump 104. As the downhole pump 104 begins moving upward, the standing valve 158 and the traveling valve 160 close and prevent the reverse flow of the formation fluid 156 captured in the well 106 from flowing back into the reservoir 152.

With each oscillation of the polishing rod 102, the anchor 122 and the downhole pump 104 oscillate through the stroke length 140. The oscillation of the downhole pump 104 mechanically lifts the formation fluid 156, such as petroleum, oil, and/or gas, upward through the well 106. In other words, the downhole pump 104 lifts the formation fluid 156 through the casing 120 and/or the tubing 144 of the well 106. In various examples, the tubing pump 104*a* pumps the petroleum through the inner diameter of the tubing 144, and the rod pump 104*b* pumps the fluid between the outer diameter of the tubing 144 and the inner diameter of the casing 120.

Figure 4:
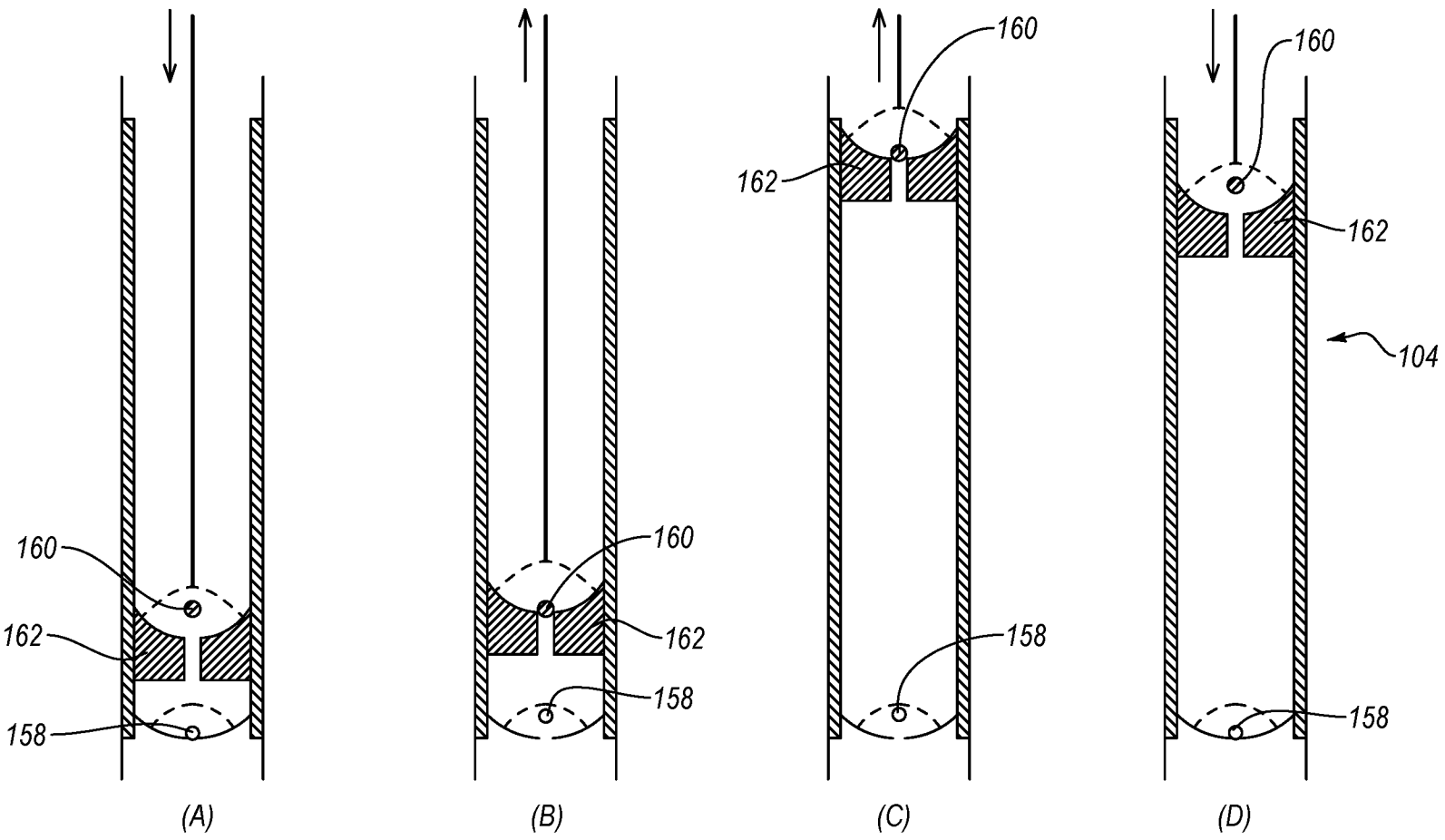
FIG. 4 is a schematic representation of the operation of a downhole pump, according to an exemplary embodiment.

FIG. 4 schematically illustrates the operation of the downhole pump 104 through each oscillation of the polishing rod 102. For example, the downhole pump 104 is a plunger 162 with a traveling valve 160 that lifts the fluid through the tubing 144 (e.g., one embodiment of a tubing pump 104*a*). In other words, as the polishing rod 102 moves the downhole pump 104 one stroke length 140, the plunger 162 lifts the formation fluids 156 at the bottom of the well 106 upwards one stroke length 140. The movement increases the pressure in the formation fluid 156 captured in the well 106, and the pressurize lifts the formation fluid 156 out of the well 106. The standing valve 158 regulates the formation fluids 156 as they enter the plunger 164, and the traveling valve 160 forces the formation fluid 156 in the plunger 164 at the bottom of the well 106 and forces/pressurizes the formation fluid 156 upwards through the tubing 144 and/or casing 120.

FIG. 4(A) shows the plunger 162 is at its minimum elevation. In operation, as the polishing rod 102 travels downward, it forces the sucker rods 142 to plunge the plunger 162 into the formation fluids 156. The traveling valve 160 opens to force the petroleum into the tubing 144 (or casing 120) directly above the plunger 162. Referring to FIG. 4(B), the plunger 162 moves up from the minimum elevation of FIG. 4(A) and pressurizes the formation fluid 156 above the plunger 162. As the polishing rod 102 returns upward, it pulls the sucker rods 142 and closes the traveling valve 160 to lift the formation fluid 156. This motion captures the fluid in the tubing 144 or casing 120 above the traveling valve 160. In other words, the trapped fluid is lifted through the tubing 144 and/or casing 120 as the polishing rod 102 pulls the plunger 162 upward. Negative pressure develops between the closed traveling valve 160 and the standing valve 158. As the plunger 162 moves upwards, the standing valve 158 is forced open due to the negative pressure. In various embodiments, the upward motion of the plunger 162 sucks the formation fluids 156 into the cavity between the open standing valve 158 and the closed traveling valve 160. The downward motion of the plunger 162 also forces the formation fluids 156 into the plunger 162 and lifts the captured formation fluid 156 with each oscillation.

At the maximum elevation of the plunger 162 shown in FIG. 3(C), the process is reversed, and the plunger 162 is pushed back into the formation fluids 156 collected at the bottom of the well 106. Concerning FIG. 3(D), as the plunger 162 is pushed into the formation fluids 156, the traveling valve 160 opens to permit the formation fluids 156 into the tubing 144 and/or casing 120 above the plunger 162. The standing valve 158 is closed to prevent the escape of the formation fluids 156 as the plunger 162 is pressed downwards. Although the process in FIG. 4 shows a tubing pump 104*a*, the same or similar processes in a rod pump 104*b* also lift the formation fluids 156 at the bottom of the well 106 through the casing 120, e.g., between the casing 120 and the tubing 144.

Figure 6:
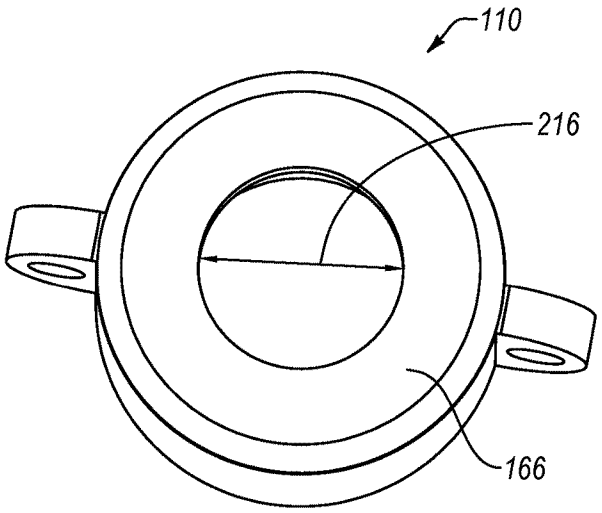
FIG. 6 is a step fitting that receives the oscillating polishing rod at the wellhead, according to an exemplary embodiment.
Figure 5:
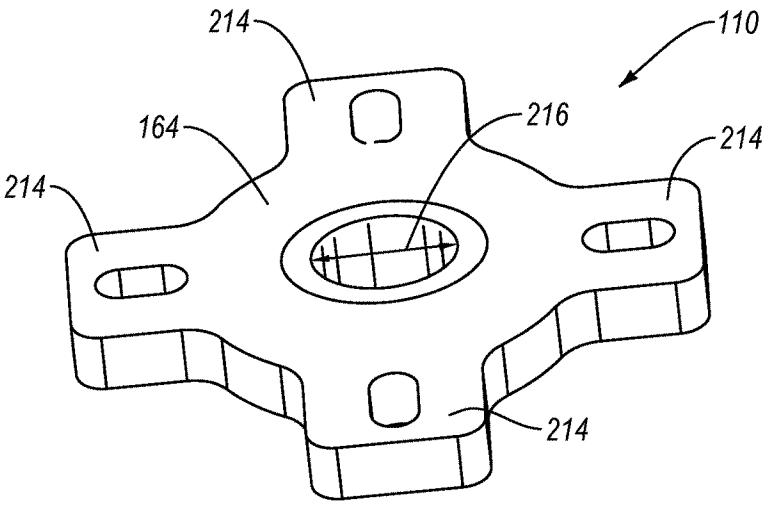
FIG. 5 is a cross-link fitting that receives the oscillating polishing rod at the wellhead, according to an exemplary embodiment.
Figure 9:
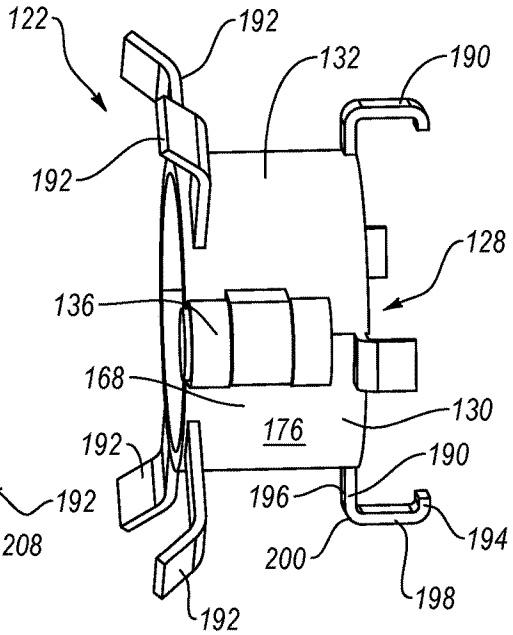
FIG. 9 is a right-side view of the anchor, according to an exemplary embodiment.
Figure 10:
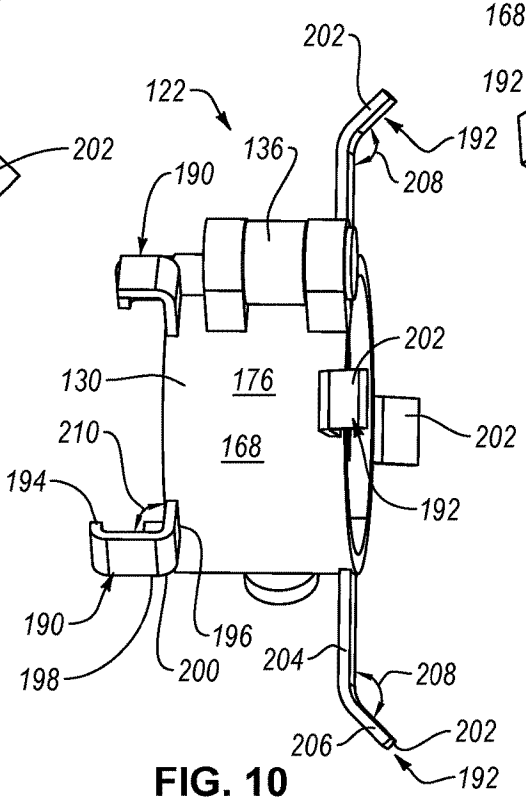
FIG. 10 is a left-side perspective view of the anchor, according to an exemplary embodiment.
Figure 14:
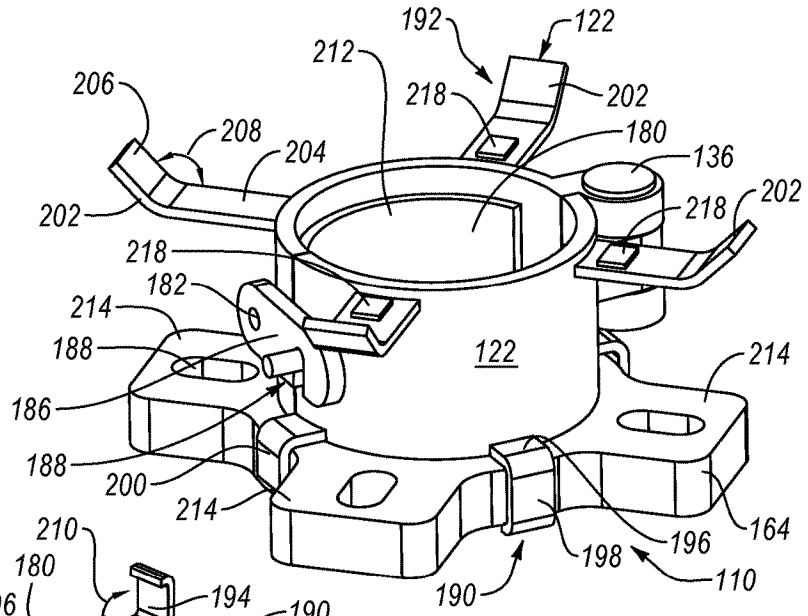
FIG. 14 is a side perspective view of the anchor coupled to the cross-linked fitting at the wellhead, according to an exemplary embodiment.
Figure 15:
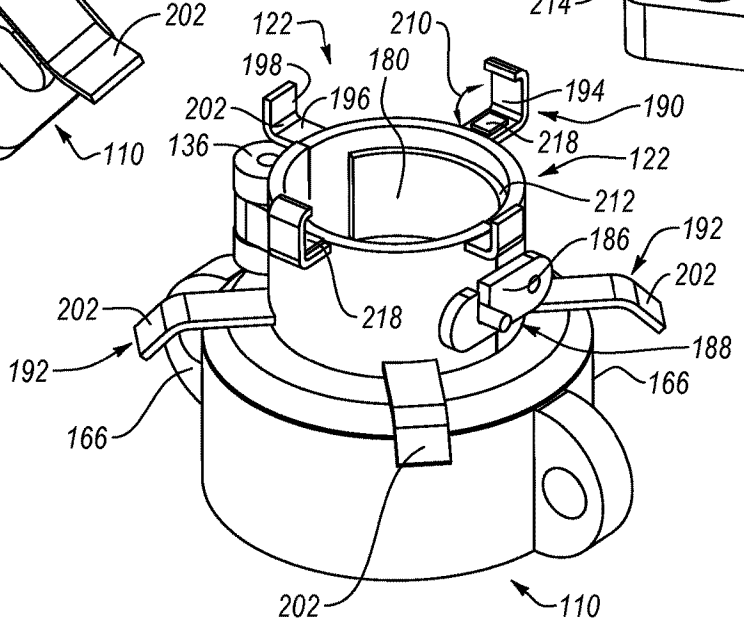
FIG. 15 is a side perspective view of the anchor coupled to the step fitting at the wellhead, according to an exemplary embodiment.
Figure 13:
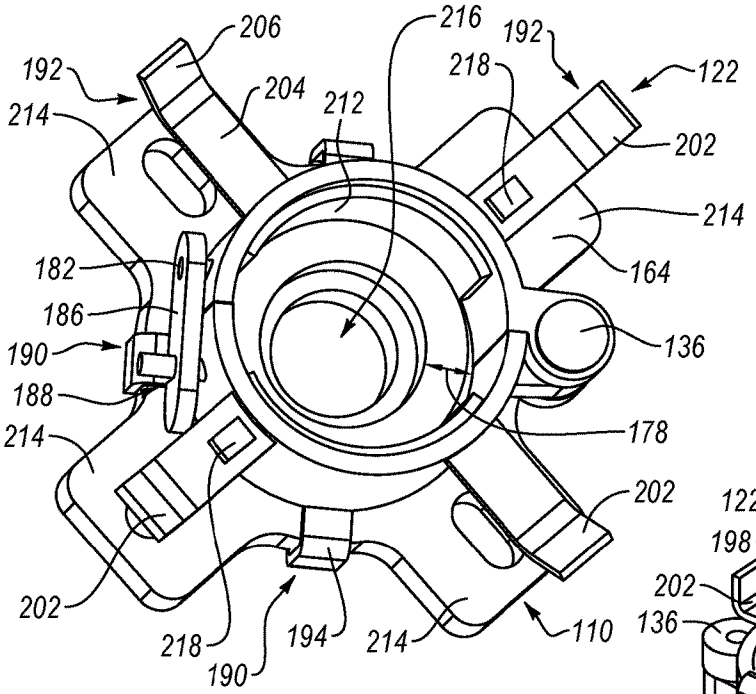
FIG. 13 is a top perspective view of the anchor coupled to the cross-link fitting at the wellhead, according to an exemplary embodiment.

FIGS. 5 and 6 show different fittings at the wellhead 110. Specifically, FIG. 5 shows a cross-link fitting 164, and FIG. 6 shows a step fitting 166. Different wellhead 110 configurations receive the polishing rod 102 as it oscillates through the wellhead 110. For example, the wellhead 110 may have a cross-link fitting 164 or the step fitting 166 show. Comparison of FIGS. 5 and 6 shows that the fitting at the wellhead 110 can have different dimensions, sizes, shapes, and/or other structures and configurations. Specifically, the cross-link fitting 164 is different than the step fitting 166 at the wellhead 110. As described in greater detail below, anchor 122 may have sizes configured to couple to two or more different wellhead 110 fittings, e.g., cross-link fitting 164 and step fitting 166. For example, the same anchor 122 can couple with the cross-link fitting 164 and with the step fitting 166 on various wellheads 110. In one example, the orientation of the anchor 122 is reversed for each of the different fittings. For example, the anchor 122 is oriented in a first direction for service on the cross-link fitting 164 and rotated 180 degrees (e.g., turned upside down) to a second direction for service on a step fitting 166. For example, FIGS. 13 and 14 show the first orientation of anchor 122 on the cross-link fitting 164, and FIG. 15 shows the anchor 122 rotated 180 degrees to couple with the step fitting 166 on another wellhead 110.

FIGS. 7-10 show the anchor 122 in isolation to illustrate various views and features of the anchor 122. The anchor 122 is made of various rigid, firm, durable, and/or toughened materials in various embodiments. For example, the anchor 122 is made from a metallic material. In another example, the anchor 122 is made from either a thermoset or thermoplastic and has a polycarbonate, polyvinyl chloride, and/or Acrylonitrile Butadiene Styrene (ABS) material. The material of the anchor 122 should be sufficiently stiff and/or rigid to support compressive loads on the polishing rod 102. In this way, the anchor 122 provides a normal force on the exterior surface 126 to abrade and/or maintain a smooth polishing rod 102.

In one embodiment, the anchor 122 is circular or annular. For example, the first sidewall 130 and the second sidewall 132 are semicircles and oriented opposite each other to form a cylindrical sidewall 168. In this embodiment, the closed anchor 122 forms a circle around the polishing rod 102. The cylindrical sidewall 168 (e.g., the combination of the first and second sidewalls 130 and 132) has an inner diameter 170 defining an inner surface 172 opposite an outer diameter 174 defining an outer surface 176. For example, the inner surface 172 of the cylindrical sidewall 168 is defined by the inner diameter 170, and the outer surface 176 is defined by the outer diameter 174. In various embodiments, the inner diameter 170 of the first sidewall 130 is equal to the inner diameter 170 of the second sidewall 132 to create a circular inner surface 172 of the cylindrical sidewall 168. Similarly, the outer diameter 174 of the first sidewall 130 is the same as the outer diameter of the second sidewall 132 to create a circular outer surface 176 of the cylindrical sidewall 168. The radial difference between the inner surface 172 and the outer surface 176 defines the thickness of the cylindrical sidewall 168.

The inner surface 172 between the first sidewall 130 and the second sidewall 132 forms the clamping area 128 that abrades the polishing rod 102. The clamping area 128 is defined by the inner surface 172 of the anchor 122 when in a locked position. The clamping area 128 is larger than the polishing rod 102, such that the anchor 122 fits around the polishing rod 102. In other words, there is a distance between the exterior surface 126 of the polishing rod 102 and the inner surface 172 of the anchor 122. The space between the inner surface 172 of the cylindrical sidewall 168 and the polishing rod 102 forms a gap 178 that encircles the polishing rod 102 when the anchor 122 is closed. In various embodiments, the inner diameter 170 of the cylindrical sidewall 168 is between 1 inch and 5 inches, specifically, between 2 inches and 4 inches, and more specifically, between 2.5 inches and 3.5 inches.

In some embodiments, sand, shells, walnut shells, peanut shells, and/or are packed into the gap 178 between the inner surface 172 of the anchor 122 and the exterior surface 126 of the polishing rod 102. The packed sand in the gap 178 abrades the exterior surface 126 of the polishing rod 102 along the longitudinal axis 134 as the polishing rod oscillates. In other words, the sand abrades and/or removes any abnormalities on the exterior surface 126 of the polishing rod 102. For example, the anchor 122 is a rod polisher that abrades the exterior surface of the polishing rod 102 to maintain the seal 124 between the polishing rod 102 and the wellhead 110 on the stuffing box 108.

The polishing rod 102 can have a variety of cross-sectional shapes. For example, the polishing rod 102 can have a circular, square, rectangular, convex, concave, cross-sectional shape. In one embodiment, the polishing rod 102 has a circular cross-sectional shape, such that the exterior surface 126 of the polishing rod 102 is circular. In this configuration, the exterior surface 126 of the polishing rod 102 has a first diameter, and the anchor 122 has a cylindrical sidewall 168 defined by the inner diameter 170 in the closed position. The first diameter of the polishing rod 102 defines a first radius, and the inner diameter 170 of the cylindrical sidewall 168 defines a second radius. In one embodiment, the second radius of the inner cylindrical sidewall 168 is more than 0.25", 0.50", 0.75", 1", 1.25", 1.5", 1.75", 2" or greater than the first radius of the outer polishing rod 102.

In another embodiment, the exterior surface 126 of the polishing rod 102 is non-circular. For example, the polishing rod 102 has a concave square cross-sectional shape. The anchor 122 may be circular or non-circular and captures the polishing rod 102 to form a gap 178 that is non-circular. Sand or another abrasive material is packed into the gap 178 to polish the polishing rod 102 during operation.

In one embodiment, an abradant 180 (e.g., sand) is captured in the clamping area 128. The abradant 180 facilitates the packing process in the gap 178. For example, the abradant may fill the gap 178 between the exterior surface 126 of the polishing rod 102 and the inner surface 172 of the anchor 122. In one embodiment, the abradant 180 is a single piece that fills the gap 178 between the exterior surface 126 of the polishing rod 102 and the inner surface 172 of the anchor 122. In this configuration, the abradant 180 provides a normal force on the exterior surface 126 of the polishing rod 102 that increases the friction of the abradant 180 and enhances the maintenance of the polishing rod 102. In one embodiment, the abradant 180 is made from a carbide steel material.

The radial hinge 136 is located externally to the clamping area 128. In other words, the radial hinge 136 remains outside of the clamping area 128 in the closed position. The radial hinge 136 rotates the first sidewall 130 and/or the second sidewall 132 between the open position, shown in FIG. 12, and the closed position, shown in FIG. 11. The radial hinge opens/closes the anchor 122 to facilitate capturing the polishing rod 102. For example, the radial hinge 136 enables the anchor 122 to be installed on the polishing rod 102 during operation and/or while the polishing rod 102 is oscillating. In other words, the radial hinge 136 facilitates an open configuration of the anchor 122 that enables an operator to apply the anchor 122 on the pumpjack 100 while moving the polishing rod 102 and without changing or stopping the continuous operation of the pumpjack 100.

The first sidewall 130 rotates about the radial hinge 136 relative to the second sidewall 132 to open and/or close the anchor 122. The radial hinge 136 extends axially parallel to the longitudinal axis 134 and couples the first sidewall 130 to the second sidewall 132 to create the jaw-like clamp. In one embodiment, the radial hinge 136 is located on an exterior surface 126 of the cylindrical sidewall 168 (e.g., one of the first sidewall 130 or the second sidewall 132.)

The anchor 122 includes a second or transverse hinge 182 extending from the outer surface 176 of the cylindrical sidewall 168 to lock the anchor 122 in the clamped or closed position. The transverse hinge 182 rotates about a transverse axis 184 that is orthogonal to the longitudinal axis 134. The transverse hinge 182 extends along the outer surface 176 of the cylindrical sidewall 168 to lock the first sidewall 130 relative to the second sidewall 132 and maintain the compressive normal force in the clamping area 128 on the polishing rod 102. The transverse hinge 182 has a shaft 186 that locks the first sidewall 130 to the second sidewall 132. The shaft 186 rotates about the transverse hinge 182 on the exterior surface 126 of the cylindrical sidewall 168 and locks the first sidewall 130 relative to the second sidewall 132. The shaft 186 is located on the exterior surface 126 of the first sidewall 130 or the second sidewall 132 and releasably couples or joins to the other of the second sidewall 132 or the first sidewall 130 at the other end of the transverse hinge 182.

For example, a clasp 188 on the shaft 186 is located opposite the transverse hinge 182. The clasp 188 selectively and/or releasably couples the shaft 186 to the cylindrical sidewall 168 to lock the anchor 122 in the locked or closed position. Stated differently, when shaft 186 is coupled to the first sidewall 130 at the transverse hinge 182, the clasp 188 couples the shaft 186 to the opposite or second sidewall 132. Similarly, the shaft 186 may couple to the transverse hinge 182 on the second sidewall 132, and the clasp 188 can couple the shaft to the first sidewall 130. In this way, the shaft 186 rotates about the transverse hinge 182 to selectively couple the clasp 188 and lock the first sidewall 130 relative to the second sidewall 132.

In one embodiment, the clasp 188 is on an opposite side of the cylindrical sidewall 168 from the radial hinge 136. The radial hinge 136 opens and closes the anchor 122, and the clasp 188 locks the first sidewall 130 relative to the second sidewall 132. In this way, the clasp 188 provides a compressive force on the abradant 180 captured in the clamping area 128 to retain the abradant 180 within the clamping area 128.

As shown in FIGS. 7-10, the anchor 122 has arms and/or protrusions to secure the anchor 122 on the wellhead 110. The anchor 122 abuts the seal 124 and creates the seal 124 between the interior and exterior of the well 106. For example, the anchor 122 has a series of arms that form a mooring hitch 190. The mooring hitch 190 extends outward from the cylindrical sidewall 168 and secures the anchor 122 against the wellhead 110. Similarly, a support bracket 192 is located opposite the mooring hitch 190 on the cylindrical sidewall 168. For example, if the mooring hitch 190 is on the bottom of the cylindrical sidewall 168, the support bracket 192 is located on the top of the cylindrical sidewall 168. In various embodiments, the mooring hitch 190 is configured to fit a first wellhead 110, and the support bracket 192 is configured to fit a second wellhead 110. For example, the mooring hitch 190 fits a cross-link fitting 164, and the support bracket fits a step fitting 166 wellhead 110. The support bracket 192 extends from the cylindrical sidewall 168 and secures the anchor 122 against the seal 124 on the polishing rod 102.

In various examples, the mooring hitch 190 has a protrusion 194 with a first portion 196 and a second portion 198 separated by a bend 200. The first portion 196 extends in a transverse direction from the cylindrical sidewall 168. The bend 200 divides the first portion 196 of the protrusion 194 from the second portion 198 on the mooring hitch 190. In one example, the second portion 198 of the protrusion 194 extends substantially parallel to the longitudinal axis 134. In various embodiments, the mooring hitch 190 has one or more protrusions 194 configured to support the anchor 122 about the polishing rod 102 on the wellhead 110.

Similarly, the support bracket 192 has a projection 202 that has a first portion 204 and a second portion 206 divided by an obtuse angle 208. The first portion 204 of the support bracket 192, extends at an angle from the cylindrical sidewall 168. The second portion 206 forms the obtuse angle 208 with the first portion 204 of the projection 202. In various embodiments, the support bracket 192 has one or more projections 202 configured to support the seal 124 on the polishing rod 102. In one embodiment, an angle 210 of the bend 200 in the protrusion 194 of the mooring hitch 190 is less than the obtuse angle 208 in the projection 202 on the support bracket 192.

In some embodiments, the mooring hitch 190 has protrusions 194 extending from the cylindrical sidewall 168 that secure the anchor 122 on a wellhead 110 in a first orientation and support the seal 124 in a second orientation. For example, the mooring hitch 190 is configured for the cross-link fitting 164, and the support bracket 192 is configured for the step fitting 166 wellhead 110. In some embodiments, the support bracket 192 has projections 202 opposite the mooring hitch 190 that extend from the cylindrical sidewall 168 and secure the seal 124 of the polishing rod 102 in a first orientation and support the anchor 122 against the wellhead 110 in a second orientation.

FIG. 11 shows the transverse hinge 182 unlocked, and the anchor 122 is in a closed position. FIGS. 7 and 8 show the transverse hinge 182 in a locked position. In the closed position of FIG. 11, the first sidewall 130 and the second sidewall 132 define the clamping area 128. In a specific embodiment, when the first sidewall 130 and the second sidewall 132 are semicircles, the clamping area 128 is circular (e.g., forms a circle).

To open the anchor 122, the operator rotates the first sidewall 130 relative to the second sidewall 132. FIG. 12 shows the anchor 122 in the open position. The distance between the first sidewall 130 and the second sidewall 132 in the open position is width W. The width W of the anchor 122 facilitates the installation of the anchor 122 on a polishing rod 102 that is smaller than the width W. In some embodiments, the open position of the anchor 122 is greater than an exterior surface 126 (e.g., diameter) of the polishing rod 102. For example, the clamping area 128 defines an inner diameter 170 that is greater than the outer diameter of the polishing rod 102. The difference between the inner diameter 170 of the cylindrical sidewall 168 and the diameter, width, or exterior surface 126 of the polishing rod 102 defines the gap 178. Stated differently, the gap 178 is the volume in the clamping area 128 of the anchor 122 between the inner surface 172 of the cylindrical sidewall 168 and the exterior surface 126 of the polishing rod 102.

In some embodiments, the gap 178 is configured for a pad 212 interposed between the cylindrical sidewall 168 and the abradant 180. For example, the pad 212 may be a non-yielding plastic material that deforms about an abnormality (e.g., rust) on the polishing rod 102. In various examples, the pad 212 deflects and/or creates a normal spring force on the corrosion layer or other abnormality on the exterior surface 126 of the polishing rod 102.

FIGS. 13 and 14 show perspective views of the anchor 122 coupled to the cross-link fitting 164 on the wellhead 110. As shown in this configuration, the mooring hitch 190 has one or more protrusions 194 configured to support the anchor 122 about the polishing rod 102 on the cross-link fitting 164 at the wellhead 110. Specifically, the protrusions 194 are configured to extend about the sides of the cross-link fitting 164 and fit between extensions 214 on the cross-link fitting 164. The support bracket 192 has projections 202 configured to support the seal 124 on the opposite side of the anchor 122. The cross-link fitting 164 of the wellhead 110 includes an opening 216 configured to receive the polishing rod 102. The gap 178 between the inner surface 172 of the cylindrical sidewall 168 and the polishing rod 102 is illustrated in FIG. 13, where the concentric circle created by the inner diameter 170 encircles the opening 216 that receives the exterior surface 126 of the polishing rod 102. FIGS. 13 and 14 show the anchor 122 in a closed and locked position and oriented on the cross-link fitting 164 of the wellhead 110. In some embodiments, the cylindrical sidewall 168 and/or protrusions 194 on the mooring hitch 190 of the anchor 122 have a magnet 218 that couples and retains the anchor 122 on the cross-link fitting 164 of the wellhead 110.

FIG. 15 is a side perspective view of the anchor 122 in a closed and locked position on the step fitting 166 of the wellhead 110. As shown in this configuration, the support bracket 192 supports the anchor 122 about the polishing rod 102 at the step fitting 166 at the wellhead 110. Specifically, the projections 202 on the support bracket 192 are adapted for the shape of the step fitting 166. The protrusions 194 of the mooring hitch 190 support the seal 124 on the polishing rod 102 above the anchor 122. The support bracket 192 is on the opposite side of the anchor 122 from the mooring hitch 190.

In one embodiment, a magnet 218 is located on the projections 202 or the cylindrical sidewall 168 to support and retain the anchor 122 on the step fitting 166 wellhead 110. FIGS. 13-15 show the same anchor 122 configured for two or more different types of wellheads 110. Specifically, the anchor 122 is configured for both the cross-link fitting 164 and the step fitting 166 on the wellhead 110. In one embodiment, the magnets 218 are located on both sides (e.g., the top and the bottom) of the cylindrical sidewall 168. For example, the protrusions 194 of the mooring hitch 190 and/or the projections 202 of the support bracket 192 may have one or more magnets 218 on either or both sides of the cylindrical sidewall 168 to support and retain the anchor 122 on different types of wellheads 110. Magnets 218 can be located on the mooring hitch 190 and/or the support bracket 192 to secure the anchor 122 relative to the wellhead 110 and/or seal 124.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive unless expressly specified otherwise. The terms "a," "an," and "the" also refer to "one or more" unless expressly specified otherwise.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. However, one skilled in the relevant art will recognize that the invention may be practiced without one or more of the specific details or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps or portions of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

As used herein, a list with a conjunction of "and/or" includes any single item in the list or a combination of items in the list. For example, a list of A, B, and/or C includes only A, only B, only C, a combination of A and B, a combination of B and C, a combination of A and C, or a combination of A, B, and C. As used herein, a list using the terminology "one or more of" includes any single item in the list or a combination of items in the list. For example, one or more of A, B, and C includes only A, only B, only C, a combination of A and B, a combination of B and C, a combination of A and C, or a combination of A, B and C. As used herein, a list using the terminology "one of" includes one and only one of any single item in the list. For example, "one of A, B and C" includes only A, only B or only C and excludes combinations of A, B, and C. As used herein, "a member selected from the group consisting of A, B, and C," includes one and only one of A, B, or C, and excludes combinations of A, B, and C." As used herein, "a member selected from the group consisting of A, B, and C and combinations thereof" includes only A, only B, only C, a combination of A and B, a combination of B and C, a combination of A and C or a combination of A, B, and C.

The present invention may be embodied in other specific forms without departing from its spirit or essential characteristics. The described embodiments are to be considered in all respects only as illustrative and not restrictive. Therefore, the scope of the invention is indicated by the appended claims rather than by the preceding description. All changes which come within the meaning and range of equivalency of the claims are to be embraced within their scope.

I claim:

1. An apparatus to preserve a seal about an oscillating rod, the apparatus comprising:

an anchor, comprising:

a first sidewall extending about a longitudinal axis defined along an axis of the oscillating rod;

a second sidewall extending about the longitudinal axis and opposite the first sidewall;

a radial hinge extending parallel to the longitudinal axis and coupling the first sidewall to the second sidewall on an external surface of the first sidewall and the second sidewall;

a transverse hinge extending from the external surface and along a transverse axis that is orthogonal to the longitudinal axis, the transverse hinge coupling a closure mechanism on the external surface of one of the first sidewall or the second sidewall;

a clasp on the closure mechanism and opposite the transverse hinge that selectively couples the closure mechanism to the first sidewall and the second sidewall;

a first set of securing arms extending from a first end of the first sidewall and a first end of the second sidewall;

a second set of securing arms extending from a second end of the first sidewall and a second end of the second sidewall opposite the first set of securing arms; and a clamping area formed between inner surfaces of the first sidewall and the second sidewall when the first sidewall and the second sidewall are coupled together by the closure mechanism, the oscillating rod passing through the clamping area, the first sidewall and the second sidewall forming a seal about the oscillating rod, wherein the inner surfaces of the first and second sidewalls forms a gap within the clamping area around the oscillating rod for inserting an abradant that abrades the oscillating rod as the oscillating rod oscillates through the clamping area.

2. The apparatus of claim 1, wherein the first sidewall is a semicircle, and the second sidewall is a semicircle, and wherein the second sidewall is opposite the first sidewall to create a cylindrical sidewall.

3. The apparatus of claim 1, further comprising a magnet on one of the first sidewall and the second sidewall that couples the anchor to a wellhead.

4. The apparatus of claim 1, wherein the anchor is made from a thermoset or thermoplastic comprising one or more of polycarbonate, polyvinyl chloride, or Acrylonitrile Butadiene Styrene.

5. The apparatus of claim 1, wherein the anchor is made from a metallic material.

6. The apparatus of claim 1, wherein the first set of securing arms or the second set of securing arms secures the anchor on a wellhead.

7. The apparatus of claim 1, wherein the second set of securing arms secures the anchor on an O-ring of the oscillating rod.

8. The apparatus of claim 1, wherein each of the first set of securing arms comprises a protrusion with a first portion that extends in a transverse direction from the first sidewall or the second sidewall, and wherein the protrusion has a bend such that a second portion of the protrusion extends parallel to the longitudinal axis.

9. The apparatus of claim 1, wherein each of the second set of securing arms comprises a projection that has a first portion that extends at an angle from the first sidewall and the second sidewall and a second portion that forms an obtuse angle with the first portion of the projection.

10. The apparatus of claim 1, wherein the abradant comprises packed sand that abrades the oscillating rod along the longitudinal axis.

11. The apparatus of claim 1, wherein the oscillating rod has a concave square cross-sectional shape.

12. The apparatus of claim 1, wherein the oscillating rod has a circular cross-sectional shape with a first radius, and the anchor has a cylindrical sidewall with a second radius, the second radius more than one-half inch greater than the first radius.

13. An anchor, comprising:

a cylindrical sidewall comprising:

a first jaw;

a second jaw opposite the first jaw, wherein in a closed position the first jaw and the second jaw define a clamping area;

a radial hinge located external to the first jaw and the second jaw such that the radial hinge is external from the clamping area in the closed position and rotates the first jaw and the second jaw between an open position and a closed position;

a plurality of mooring hitches extending from a first end of the first jaw and a first end of the second jaw;

a plurality of support brackets extending from a second end of the first jaw and a second end of the second jaw opposite the plurality of mooring hitches;

a magnet on one of the first jaw and the second jaw that secures the anchor to a wellhead; and a clasp opposite the radial hinge that locks the first jaw relative to the second jaw, wherein the clamping area provides a compressive force on an abradant, the abradant inserted into a gap within the clamping area to retain the abradant in the clamping area when the first jaw and the second jaw are in the closed position for abrading an oscillating rod as the oscillating rod oscillates through the clamping area.

14. The anchor of claim 13, wherein the abradant is made from a carbide steel material.

15. The anchor of claim 13, further comprising an opening between the first jaw and the second jaw in the open position that is greater than a diameter of an oscillating rod, and wherein the clamping area has an internal diameter that is less than the diameter of the oscillating rod.

16. The anchor of claim 13, further comprising a pad interposed between the cylindrical sidewall and the abradant.

17. The anchor of claim 16, wherein the pad creates a normal spring force on a corrosion layer of an oscillating rod.

18. An apparatus, comprising:

a longitudinal axis defined along an axial axis of an oscillating rod;

an anchor coupled to the oscillating rod, the anchor comprising:

a cylindrical sidewall comprising:

a first semicircular sidewall extending about the longitudinal axis; and a second semicircular sidewall extending about the longitudinal axis opposite the first semicircular sidewall, wherein in a closed position the first semicircular sidewall and the second semicircular sidewall define a clamping area;

a radial hinge on an external surface of the anchor located external to the cylindrical sidewall and extending parallel to the longitudinal axis, wherein the radial hinge is external from the clamping area and rotates the first semicircular sidewall and the second semicircular sidewall between an open position and a closed position;

a transverse hinge extending from the external surface and along a transverse axis that is orthogonal to the longitudinal axis, the transverse hinge coupling a rod on the external surface of one of the first sidewall or the second sidewall;

a first set of securing arms extending from a first end of the first sidewall and a first end of the second sidewall, each of the first set of securing arms comprising a protrusion with a first portion that extends in a transverse direction from the first sidewall or the second sidewall, and wherein the protrusion has a bend such that a second portion of the protrusion extends parallel to the longitudinal axis;

a second set of securing arms extending from a second end of the first sidewall and a second end of the second sidewall opposite the first set of securing arms, each of the second set of securing arms comprising a projection that has a first portion that extends at an angle from the first sidewall and the second sidewall and a second portion that forms an obtuse angle with the first portion of the projection; and a clasp opposite the radial hinge on the cylindrical sidewall and opposite the transverse hinge on the rod, the clasp selectively coupling the first semicircular sidewall relative to the second semicircular sidewall, wherein the clasp provides a compressive force on an abradant and retains the abradant in the clamping area between the first semicircular sidewall and the second semicircular sidewall for abrading the oscillating rod as the oscillating rod oscillates through the clamping area.

19. The apparatus of claim 18, further comprising a mooring hitch having a protrusion extending from the cylindrical sidewall that secures the anchor on a wellhead and a support bracket having a projection opposite the mooring hitch extending from the cylindrical sidewall that secures the anchor on an O-ring that seals the oscillating rod, wherein an angle of a bend in the protrusion is less than an angle of a bend in the projection.

20. The apparatus of claim 18, further comprising a portion of the clamping area that is capable of holding the abradant against the oscillating rod.

* * * * *